United States Patent [19]

Beaulieu

[11] Patent Number: 5,022,569

[45] Date of Patent: Jun. 11, 1991

[54] GARMENT HANGER FOR SIMULTANEOUSLY DISPLAY OF UPPER AND LOWER BODY COVERING GARMENTS INTERCHANGEABLY

[76] Inventor: Josette Beaulieu, 480 St. Joseph Street, Ste-Brigitte-des-Saults, Canada, J0C 1E0

[21] Appl. No.: 479,993

[22] Filed: Feb. 14, 1990

[51] Int. Cl.[5] ..... A47G 25/16; A47G 25/28; A47G 25/48; A47G 25/14

[52] U.S. Cl. ..... 223/88; 223/85; 223/90

[58] Field of Search ..... 223/85, 88, 92, 95, 223/91, 93, 96, 68; D6/317, 315

[56] References Cited

U.S. PATENT DOCUMENTS

| | | | |
|---|---|---|---|
| 1,096,018 | 5/1914 | Buchwald | 223/85 |
| 1,184,724 | 5/1916 | Connor et al. . | |
| 1,254,719 | 1/1916 | Moschcowitz . | |
| 2,639,844 | 5/1953 | Udvardy . | |
| 2,719,656 | 10/1955 | Cromartie . | |
| 2,778,551 | 1/1957 | Moore . | |
| 2,998,903 | 9/1961 | Day . | |
| 3,059,824 | 10/1962 | Henry | 223/88 |
| 4,474,316 | 10/1984 | Philibert | 223/88 |
| 4,871,098 | 10/1989 | Bredeweg et al. | 223/85 |
| 4,892,237 | 1/1990 | Duester et al. | 223/85 |

FOREIGN PATENT DOCUMENTS

| | | | |
|---|---|---|---|
| 644306 | 7/1962 | Canada . | |
| 1423902 | 2/1976 | United Kingdom | 223/85 |

*Primary Examiner*—Werner H. Schroeder
*Assistant Examiner*—Bibhu Mohanty

[57] ABSTRACT

The garment hanger has an upper part, in the shape of a head and of a torso. The head has a lateral recess forming a hook to suspend the garment hanger which further includes a hip-shape lower part adapted to be removably suspended from the upper part. The upper part is adapted to support and display an upper body-covering garment, such as a corsage, shirt, vest and the like, while the lower part is adapted to support and display a lower body-covering garment, such as a skirt, pants and the like. The lower part includes a U-shape member defining a bight and a pair of upwardly converging legs and a generally oval loop member extending across and secured at its ends to the upper ends of said legs and disposed in a plane normal to the plane of the U-shape member. A suspension rod upstands from and is fixed to the center of the bight portion and extends through, spacedly from and above the shaping member to be terminated by a hook at its upper end for detachable connection with the upper part. Because the suspension rod is spaced from the loop member inside the same, the lower portion of a shirt or the like supported on the upper part can be inserted within the loop member around the suspension rod, with the pants or skirt surrounding said lower shirt portion.

17 Claims, 3 Drawing Sheets

GARMENT HANGER FOR SIMULTANEOUSLY DISPLAY OF UPPER AND LOWER BODY COVERING GARMENTS INTERCHANGEABLY

FIELD OF THE INVENTION

The present invention relates to a garment hanger, more particularly to be used as mannequin for displaying garments.

BACKGROUND OF THE INVENTION

Conventional hangers are normally used for suspending women's garments from racks in stores. Such hangers are used for full garments such as dresses and also for upper body-covering garments, such as blouses, shirts and the like, while special hangers are used for lower body-covering garments, such as skirts, pants and the like. To applicant's knowledge, there are no known devices for hanging and displaying coordinates, namely: separate upper body garments and lower body garments as an assembly, while allowing detachment of the two hanger units for separately displaying the same and for permitting coordination of different types or models or colors of a lower body garment, with an upper one, and vice versa.

U.S. Pat. No. 2,998,903 to Day, dated Sept. 5, 1961 and entitled: "GARMENT DRYING HANGER", shows an upper hanger unit, indicated at 10, to which is detachably hooked at 19 a lower arrangement 18A; however the latter is used for shaping the lower portion of an entire dress and not for hanging and displaying a separate lower body garment, such as a skirt, pants and the like.

The same holds true for U.S. Pat. No. 2,639,844 to Udvardy, dated May 26, 1953 and entitled: "GARMENT DEVICE DISPLAY".

OBJECTS OF THE INVENTION

It is the general object of the invention to provide a garment hanger made of two-detachable parts for supporting and displaying garment coordinates, that is separate upper and lower body-covering garments.

Another object of the present invention is to provide a garment coordinate supporting and displaying hanger in which the lower portion of the upper body-covering garment, such as a blouse, can be inserted within the upper portion of the lower body-covering garment, such as a skirt, pants or the like, so as to display the garment coordinates in a natural manner.

Another object of the invention is to provide a garment hanger of the character described, which has a minimum thickness, so as to permit hanging several garment coordinates in a given length of a support rack.

Another object of the invention is to provide a garment hanger of the character described, which is inexpensive to manufacture.

SUMMARY OF THE INVENTION

There is disclosed a garment hanger to display together an upper body-covering garment and a distinct lower body-covering garment. The garment hanger comprises an upper part forming a hook section for engaging a support and a body section shaped to form shoulder zones and a waist zone, and a lower part including a planar U-shape member defining a bight portion and a pair of upstanding legs, an elongated loop member defining an opening therethrough, said loop member extending across and secured at its ends to the upper ends of said legs and disposed in a plane generally normal to the plane of the U-shape member, and a suspension rod extending from and fixed to the bight portion intermediate said legs and generally in the plane thereof, the suspension rod extending through said opening, spacedly from and above said loop member, and hook means at the upper end of said support rod to detachably suspend the lower part from said waist zone.

The loop member preferably forms a rectangular frame with rounded ends when the garment is seen in top plan view. Said loop member is slightly arced when seen in side elevation. Preferably, the lower part is provided with clamping means to clamp the waist of a lower body-covering garment around the loop member. Preferably, the upper part is flat and includes a wire member forming a closed figure consisting of an upper portion in the general outline of a human head; of an intermediate portion defining a human neck; and of a lower portion defining a human torso. The upper portion defines a lateral recess which forms the hook section. The lower torso portion has generally a trapezoidal shape, with its sides downwardly converging. The intermediate portion is formed by two parallel wire sections, with a spreader strip interconnecting the same. The lower part is preferably also made of wire members, with the legs of the U-shape part downwardly diverging toward the bight portion. Preferably, means are provided to maintain the flat U-shape part in the general plane of the flat upper part. These means preferably consist of an upwardly-inclined peg secured to the wire section forming the waist zone. The hook means forms a flat open hook adapted to partly surround the peg and laterally abut against the transverse wire section. Preferably also, this open hook has a downwardly-opening notch to receive the peg. Preferably, the wire sections forming the shoulder zones are widened. Preferably, strut members reinforce the suspension rod. The clamp means are located at each end of the loop member and preferably include spring clips, each clip forming a U-shape, the bight portion of which engageable with a registering portion of a leg of the U-shape part and the sides of which are L-shape and pivoted to the loop member at their ends. The clamp means preferably further include a spring clip secured to the middle of the back of the shaping frame and providing a pair of downwardly-opening entries of different widths to selectively receive and retain clothing of different thicknesses.

DETAILED DESCRIPTION OF THE PREFERRED EMBODIMENT

Figure 3:
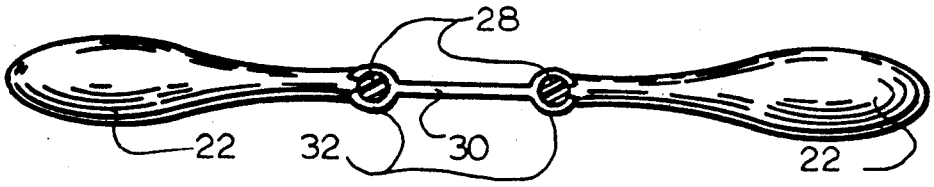
FIG. 3 is a plan section, taken along line 3—3 of FIG. 1.
Figure 4:
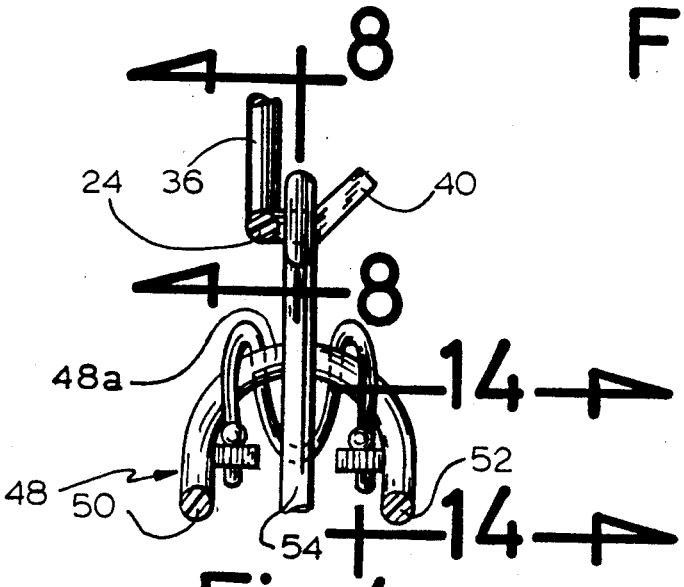
FIG. 4 is a partial vertical cross-section, taken along line 4—4 of FIG. 1.

The garment hanger, indicated at 10, includes detachably-connected upper part 12 and lower part 14. Each part is preferably made of wire members which can be plastic material or steel covered with a layer of plastic material or painted. The wire member forming the upper part is bent and shaped, so as to form an upper portion 16, of upright oval shape, imitating a human head, an intermediate portion 18 imitating a human neck and a lower portion 20 imitating a torso with shoulder zones 22 and a waist zone 24. The upper head portion 26 forms a lateral recess 26 defining hook means for hooking onto a support, such as a horizontal bar A, which may be the support bar of a store rack for suspending a plurality of garment hangers 10 one behind the other. The intermediate neck-imitating portion 18 is composed of two spaced parallel wire sections 28 interconnected by a strip 30, which, as particularly shown in FIG. 3, is fitted with spring clips 32, which are oppositely directed and engage the wire sections 28. The strip 30 serves as a spreader for the wire sections 28.

The shoulder zones 22 are generally horizontal and form rounded portion 34 joining with the sides 36 of the lower torso portion 20, these sides 36 being downwardly converging towards and joining with the waist zone 24, the latter consisting of a straight horizontal transverse wire section. Thus, the lower portion 20 has a generally trapezoidal shape.

Reinforcing wire members 38 are oppositely inclined and extend across the shoulder zones 22, being secured to the latter adjacent the intermediate neck portion 18 and to the sides 36 adjacent the shoulder zones. An upwardly-inclined peg 40 is secured to the middle of the wire section forming the waist zone 24. Peg 40 serves as a means for suspending the lower part 14. Except for peg 40, the upper part 12 is generally flat.

Figure 1:
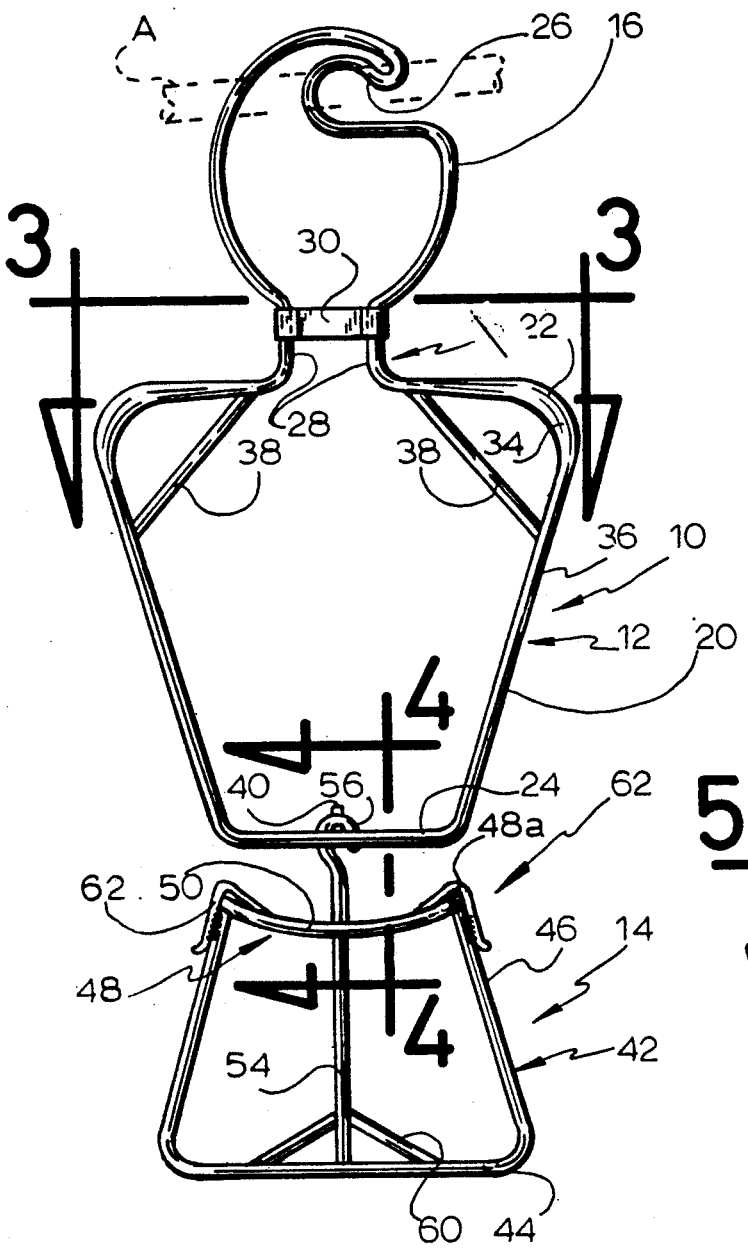
FIG. 1 is an elevation of the entire garment hanger.
Figure 2:
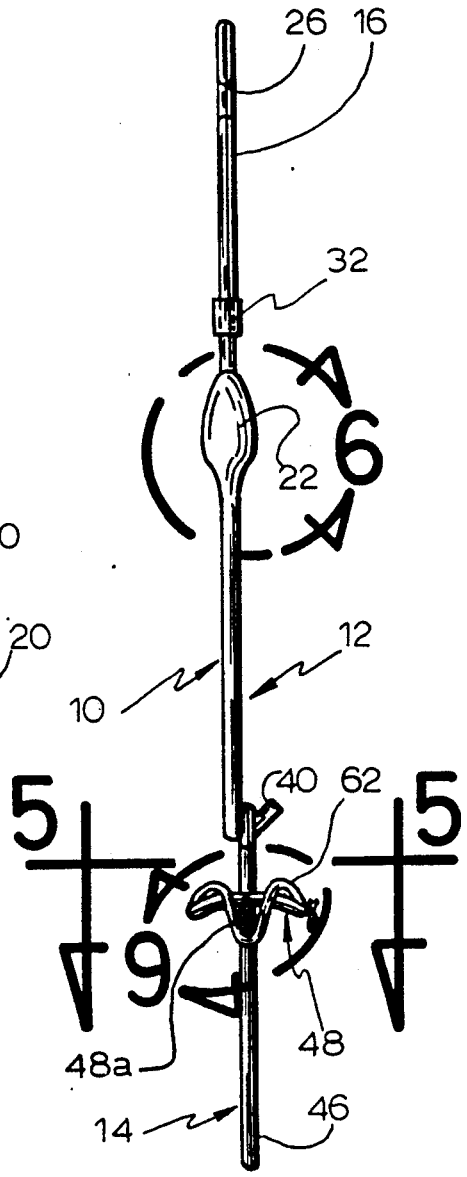
FIG. 2 is a side elevation of the same.
Figure 10:
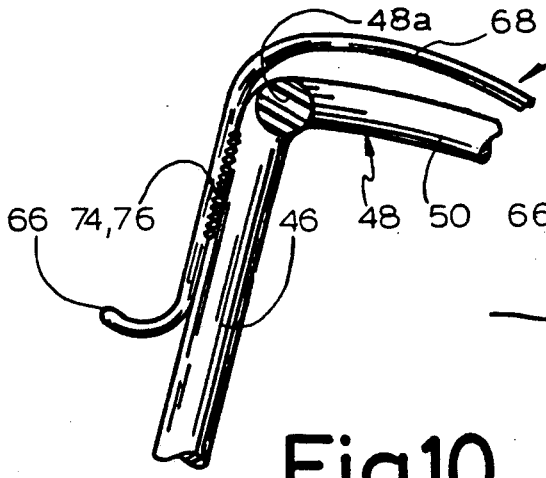
FIGS. 10 and 11 show in side elevation two different positions of one spring clip, these views being taken along line 10—10 of FIG. 9.
Figure 7:
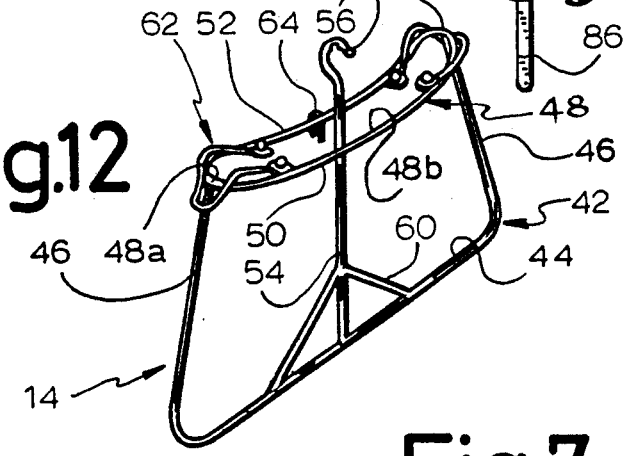
FIG. 7 is a perspective view of the lower garment hanger part.
Figure 14:
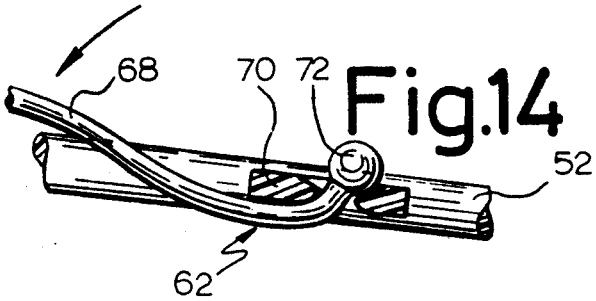
FIG. 14 is a view taken along line 14–14 of FIG. 4 and showing the pivotal portion of the spring clip of FIGS. 10 and 11.
Figure 5:
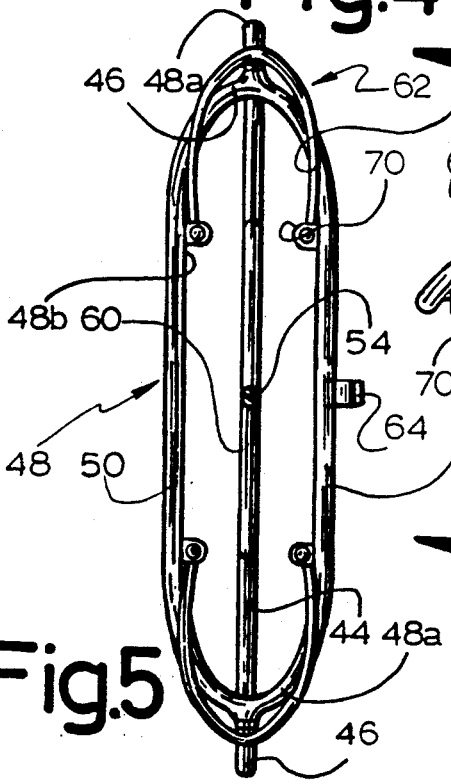
FIG. 5 is a plan section, taken along line 5—5 of FIG. 2.
Figure 9:
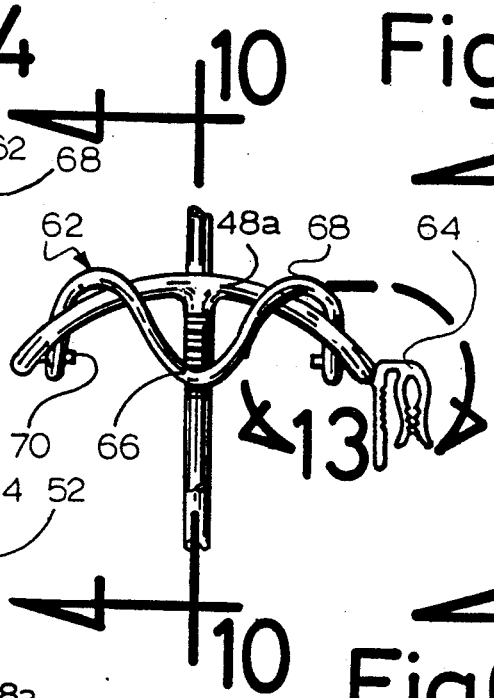
FIG. 9 is a front view of one of the spring clips, being an enlarged view of the area in circle 9 of FIG. 2.
Figure 6:
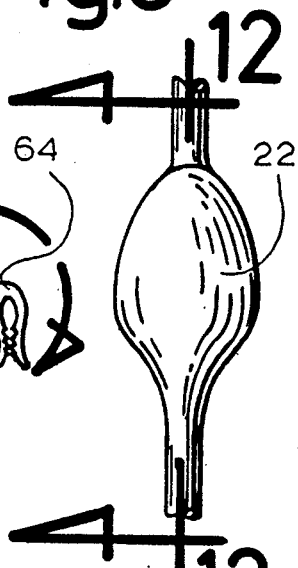
FIG. 6 is a partial elevation, on an enlarged scale, of a shoulder zone and indicated in circle 6 of FIG. 2.

The lower part 14 includes a flat U-shape member 42 with a straight transverse bight portion 44 and upwardly converging legs 46. A loop member 48, of generally elongated rectangular shape with rounded ends **48*a*, (see FIGS. 5 and 7) defining an opening 48*b* therethrough. The ends of loop member 48 are secured to the upper ends of the legs 46 and extends transversely of the plane containing U-shape member 42. As shown in FIG. 5, the U-shape member 42 is located in a plane which extends through approximately the middle of the loop member 48. In other words, the front side 50 and the back side 52 of the loop member 48 are equally spaced transversely of the plane containing the U-shape member 42. As shown in FIGS. 1 and 7, sides 50, 52** are downwardly curved from their ends, namely slightly arced when seen in side elevation.

A suspension rod 54 upstands from and is secured at its lower end to the middle of the bight portion 44. The suspension rod 54 is contained in the plane of the U-shape member 42 and freely extends through the opening **48*b* defined by the loop member 48 and above said loop member 48 to be terminated at its upper end by an open hook 56 adapted to be hooked onto the peg 40 of the upper part 12, so as to detachably suspend the lower part from the upper part. Suspension rod 54 is spaced from sides 50, 52 and from ends 48*a* of loop member 48**.

Figure 8:
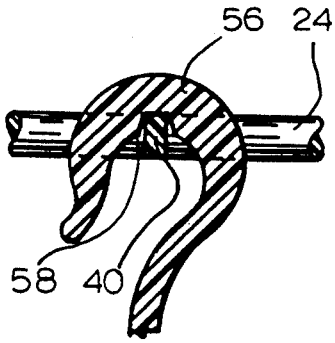
FIG. 8 is a section through the hook of the lower garment hanger part, said section taken along line 8—8 of FIG. 4.

Due to the inclination of the peg 40, the hook 56 is laterally biased under gravity against the straight, waist zone, wire member 24, and this constitutes means to positively maintain the U-shape member 42 in the same plane as that of the upper part 12. To prevent accidental disengagement of the hook 56 from the peg 40, the underside of the hook is provided with a downwardly-opening notch 58, as shown in FIG. 8, to receive the peg 40.

The connection of suspension rod 54 with the U-shape member is preferably reinforced by means of inclined struts 60 secured to the suspension rod and to the bight portion 44.

It will be appreciated that a blouse, vest, shirt or the like, which is hung on the upper part, will have its lower portion easily inserted within the loop member 48 of the lower part 14 around the suspension rod 54. On the other hand, a skirt, a pair of pants will have its waist portion secured to and around the loop member 48, which shapes it in open position, so that the lower portion of the blouse or shirt is inserted through loop member 48, into the waist portion of the pants and around the suspension rod 54. Therefore, the lower portion of the shirt is concealed by the waist portion of the pants in a natural manner. The loop member 48, due to its shape, gives a natural appearance to the waist portion of the skirt or pants.

Figure 11:
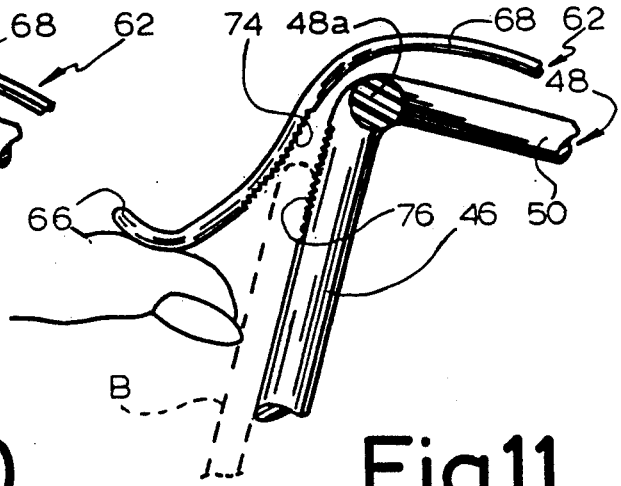
Figure 13:
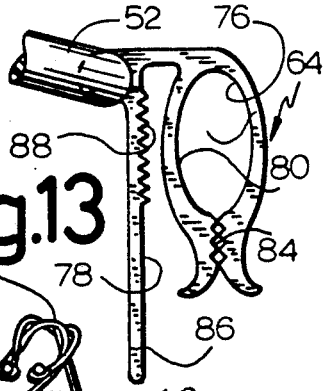
FIG. 13 is a side view of the double entry clip carried by the back of the shaping frame.
Figure 12:
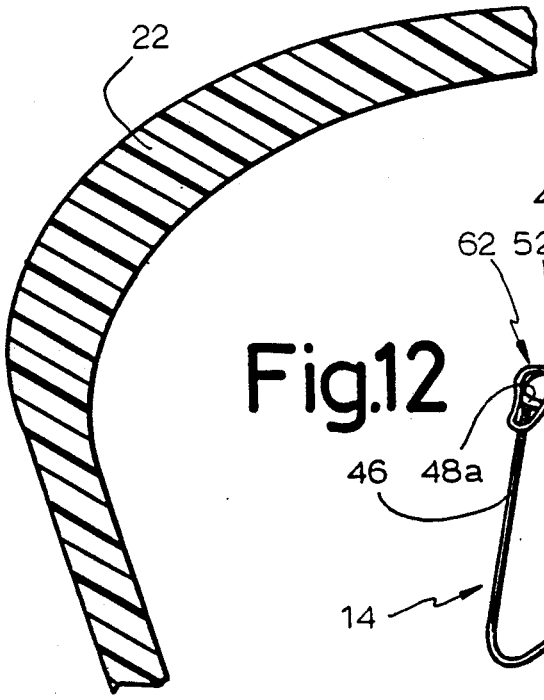
FIG. 12 is a longitudinal section of one shoulder zone, taken on line 12—12 of FIG. 6.

The skirt or pants can be secured to the loop member 48 by any type of spring clips. However, it is preferred that these clamping means be carried by the lower part itself. Such clamping means comprise a pair of spring clips 62 and a double entry spring clip 64. Spring clips 62 are mounted at both ends of the loop member 48 and cooperate with the upper portion of the legs 46 of the U-shape member 42. Each spring clip 62 consists of a U-shape member defining a bight portion 66 and L-shape sides 68, these sides inserted through the hole of ears 70 fixed on the inside of the loop member 48 and pivotally retained in these ears 70 by means of enlargements 72, these enlargements preferably being spherical. As shown, the enlargements 72 are disposed above the ears 70 and the sides 68 extend under and around the ears 70 and then on the inside of the loop member 48 and above and over the ends **48*a* of the loop member 48. The bight portions 66, together with the upper end of the legs 46 of the U-shape member 42, are provided with serrations 74, 76 at their registering portions adapted to better grip therebetween the waist portion B of a garment to be retained around the loop member 48, as shown in FIG. 11**.

It will be seen that the ears 70, against which the sides 68 abut, serve to bias the clip 62 downwardly into closed position.

The double-entry clip 64 protrudes from the central part of the back side 52 of the loop member 48. It provides two entries 76 and 78, the entry 76 formed of two resilient legs 80, 82, with opposite serrations 84. This entry 76 serves for garments of a smaller thickness. Entry 78 serves to receive and retain garments of greater thickness and comprises a third leg 86, which cooperates with leg 80, the third leg 86 provided with serrations 88 facing the leg 80.

Preferably, the shoulder zones 22 are widened and thickened, as shown in FIGS. 1, 3, 6 and 12, to better support the shoulders of the upper body-covering garment.

In practice, it is a simple matter to hang an upper body-covering garment around the torso portion 20, with the neck portion 18 and head portion 16 sticking out, so that the latter can be hung from a support bar A, which is fitted within the lateral recess 26. A skirt, a pair of pants or the like is hung around the lower part 14, with the waist section attached by the spring clips 62 and one or the other of the double-entry clip 64. The front of the garment waist is held taut by clips 62 and thus, downwardly curved front side 50 of loop member 48 is concealed by the garment waist.

The lower portion of the blouse or shirt is inserted within the pants or skirt through the loop member 48 around the suspension rod 54 after the latter has been attached to the peg 40. The garment hanger is designed more particularly to display clothes in a store. The saleswoman or the customer can easily display various combinations of a top garment with a bottom garment or just a top garment or a bottom garment. Several garment coordinates can be suspended from a rack bar, since the loop member has a restricted width, for instance about 3". Yet this loop member 48 imparts a natural appearance to the lower body garment, as well as permitting natural insertion of the lower portion of the upper body-covering garment.

I claim:

1. A garment hanger to display together separate upper body-covering garments and lower body-covering garments, comprising: an upper part forming a hook section for engaging a support and a body section shaped to form shoulder zones and a waist zone, and a lower part including a planar U-shape member defining a bight portion and a pair of upstanding legs, an elongated loop member defining an opening therethrough, said loop member extending across and secured at its ends to the upper ends of said legs and disposed in a plane generally normal to the plane of said U-shaped member, and a suspension rod upstanding from and fixed to said bight portion, intermediate said legs and generally in the plane thereof, said suspension rod freely extending through, spacedly from and above said loop member, and hook means at the upper end of said suspension rod to detachably suspend said lower part from said waist zone of said upper part.

2. A garment hanger as defined in claim 1, wherein said upper part is flat and includes a wire member forming a closed figure consisting of an upper portion, an intermediate portion and a lower portion having the general outline of a human head, of a human neck and of a human torso, respectively, the top of said upper portion defining a lateral recess forming said hook section, said U-shape member and said loop member also including wire members, said legs downwardly diverging towards said bight portion.

3. A garment hanger as defined in claim 2, wherein said lower portion of said upper part has a generally trapezoidal shape, with its sides downwardly converging, and wherein said intermediate portion includes two spaced parallel wire sections, and further including a strip interconnecting said parallel wire sections.

4. A garment hanger as defined in claim 3, wherein said strip includes oppositely-opening end clips releasably engaged by said parallel wire sections, said strip acting as a spreader for said parallel wire sections.

5. A garment hanger as defined in claim 1, wherein said upper part is flat and further including retainer means to retain said U-shape member in the general plane of said flat upper part.

6. A garment hanger as defined in claim 5, wherein said waist zone includes a straight transverse wire section and said retainer means are formed by said transverse wire section, by a peg fixed to and upwardly inclined relative to said transverse wire section and by said hook means forming a flat open hook adapted to partly surround said peg and laterally abut said transverse wire section.

7. A garment hanger as defined in claim 6, wherein said open hook has a downwardly-opening notch to receive said peg.

8. A garment hanger as defined in claim 2, wherein the sections of the wire member forming said shoulder zones are widened.

9. A garment hanger as defined in claim 7, further including a reinforcing inclined wire member joining said shoulder zones adjacent said intermediate portion with the sides of said lower portion adjacent and below said shoulder zones.

10. A garment hanger as defined in claim 1, further including reinforcing, inclined struts joining said suspension rod and said bight portion.

11. A garment hanger as defined in claim 1, wherein said loop member has a generally rectangular shape, with rounded ends, when said garment hanger is seen in top plan view.

12. A garment hanger as defined in claim 11, wherein said loop member has a front side and a back side, and wherein said front side is slightly arced when said loop member is seen in side elevation.

13. A garment hanger as defined in claim 12, further including clamping means located at each end of said loop member at its connections with said legs.

14. A garment hanger as defined in claim 13, further including additional clamping means secured to the mid-section of the back side of said loop member.

15. A garment hanger as defined in claim 12, wherein said clamping means include a pair of spring clips, each clip U-shaped with a bight portion engageable with a registering portion of a leg, and with a pair of L-shaped sides pivoted to said loop member at their ends.

16. A garment hanger as defined in claim 15, wherein said bight portion of each clip and each registering portion of said legs are serrated, the serrations facing one another when the clip is in closed position.

17. A garment hanger as defined in claim 14, wherein said additional clamping means include a spring clip with a pair of downwardly opening entries of different widths.

* * * * *